US010765214B2

(12) United States Patent
Walser

(10) Patent No.: US 10,765,214 B2
(45) Date of Patent: Sep. 8, 2020

(54) GUIDE SPRING FOR A SEATING DEVICE AND SPRUNG SEATING DEVICE

(71) Applicant: Inventor Group GmbH, Wollerau (CH)

(72) Inventor: Thomas Walser, Kreuzlingen (CH)

(73) Assignee: Inventor Group GmbH, Wollerau (CH)

( * ) Notice: Subject to any disclaimer, the term of this patent is extended or adjusted under 35 U.S.C. 154(b) by 143 days.

(21) Appl. No.: 15/990,894

(22) Filed: May 29, 2018

(65) Prior Publication Data

US 2018/0344033 A1 Dec. 6, 2018

Related U.S. Application Data

(60) Provisional application No. 62/514,181, filed on Jun. 2, 2017.

(51) Int. Cl.

| | |
|---|---|
| ***A47C 3/026*** | (2006.01) |
| ***A47C 3/22*** | (2006.01) |
| ***A47C 7/00*** | (2006.01) |
| ***A47C 3/24*** | (2006.01) |
| ***A47C 3/025*** | (2006.01) |

(52) U.S. Cl.

CPC ..... *A47C 3/026* (2013.01); *A47C 3/0252* (2013.01); *A47C 3/22* (2013.01); *A47C 3/245* (2013.01); *A47C 7/004* (2013.01); *A47C 7/006* (2013.01)

(58) Field of Classification Search

CPC ..... A47C 3/026; A47C 3/245; A47C 3/22; A47C 3/0252; A47C 7/004; A47C 9/002; A47C 7/345; A47C 7/006; A47C 7/14

USPC ..... 297/258.1, 451.7, 451.5; 267/131, 272, 267/166.1; 248/576, 577, 578

See application file for complete search history.

(56) References Cited

U.S. PATENT DOCUMENTS

| | | | | | |
|---|---|---|---|---|---|
| 380,651 | A * | 4/1888 | Fowler et al. | F16F 1/08 | 267/166.1 |
| 849,975 | A * | 4/1907 | Carlson | A47C 9/002 | 248/604 |
| 1,287,365 | A * | 12/1918 | Livingston | A47C 3/245 | 248/601 |
| 1,457,241 | A * | 5/1923 | Williams | B62J 1/02 | 267/132 |
| 1,610,069 | A * | 12/1926 | Weber | A47C 1/08 | 248/623 |

(Continued)

FOREIGN PATENT DOCUMENTS

| | | | | |
|---|---|---|---|---|
| DE | 1094948 B | * | 12/1960 | A47C 3/28 |
| DE | 202016000382 U1 | | 6/2017 | |

(Continued)

*Primary Examiner* — Milton Nelson, Jr.

(74) *Attorney, Agent, or Firm* — Smartpat PLC

(57) ABSTRACT

A guide spring for a seating device has an inner portion, an outer portion, and a spiral coiled portion extending more than one convolution between the inner portion and the outer portion. The inner portion is firmly attached to a rod and the outer portion is firmly attached to a body. The guide spring thereby secures a radial position of the rod within the body, allowing the rod to move axially relative to the body when a load is placed onto the seating device. When in use, the guide spring deforms from a flat spiral shape to a conical spiral shape with axial movement of the rod relative to the body.

20 Claims, 14 Drawing Sheets

(56) References Cited

U.S. PATENT DOCUMENTS

| | | | | | |
|---|---|---|---|---|---|
| 1,963,053 | A | * | 6/1934 | Powers | A47C 23/0438 5/256 |
| 2,048,148 | A | * | 7/1936 | Stoll | A47C 3/0252 248/583 |
| 2,298,230 | A | * | 10/1942 | Max | A47C 3/026 248/565 |
| 2,879,960 | A | | 3/1959 | Walter | |
| 3,417,956 | A | * | 12/1968 | Robert | A47C 3/026 248/576 |
| 4,377,019 | A | | 3/1983 | Takahashi | |
| 5,261,724 | A | | 11/1993 | Meiller et al. | |
| 5,524,967 | A | * | 6/1996 | Glockl | A47C 3/02 248/372.1 |
| 5,590,930 | A | * | 1/1997 | Glockl | A47C 3/0257 297/258.1 |
| 5,921,628 | A | | 7/1999 | Glockl | |
| 8,066,624 | B1 | | 11/2011 | Stroup | |
| 9,894,998 | B2 | | 2/2018 | Walser | |

FOREIGN PATENT DOCUMENTS

| | | | | | |
|---|---|---|---|---|---|
| FR | 709028 | A | * | 8/1931 | A47C 9/007 |
| FR | 2800251 | A1 | * | 5/2001 | A47C 3/30 |
| FR | 2806276 | A1 | * | 9/2001 | A47C 3/22 |
| GB | 700645 | A | | 12/1953 | |
| WO | 9319647 | A1 | | 10/1993 | |

* cited by examiner

GUIDE SPRING FOR A SEATING DEVICE AND SPRUNG SEATING DEVICE

TECHNICAL FIELD

The present disclosure relates to a guide spring for a seating device and to a sprung seating device comprising one or more guide springs.

BACKGROUND

Sprung seating devices, such as rocking stools, ideally provide axial movement of a seat. In some cases, additional lateral displacement of the seat is desired.

Mechanisms that provide axial and possibly lateral movement of a seat have traditionally been complex, requiring many different parts. Such mechanisms have been prone to friction, which can cause noise as the seat moves. Due to their complexity, known mechanisms have been relatively expensive.

Providing noise-free, sprung, vertical movement of a seat has been a particularly difficult problem to solve. Height-adjustable chairs may cause noise during vertical adjustment, which is acceptable since the adjustment is a temporary occurrence. In sprung seating devices, vertical movement of the seat coincides with even slight changes in a user's posture, and is thus a frequent occurrence. Noise-free operation is therefore very important.

It is an object of the present disclosure to provide an improved sprung seating device, for example a stool, which is relatively inexpensive to manufacture, eliminates or at least greatly reduces friction, is quiet, and is not subject to wear.

SUMMARY

A mechanism for an improved seating device is based on a rod which can axially move relative to a body. Two guide springs are provided to movably secure the rod within the body. A lower guide spring has an inner portion firmly connected to the rod and an outer portion firmly connected to the body. The inner portion is connected to the outer portion by a spiral coiled portion. An upper guide spring also has an inner portion firmly connected to the rod and an outer portion firmly connected to the body. Again, the inner portion is connected to the outer portion by a spiral coiled portion.

The mechanism may further have a plurality of stabilizing bars which are circumferentially spaced around the rod and connect the spiral coiled portion of the lower guide spring with the spiral coiled portion of the upper guide spring. The stabilizing bars may be arranged parallel to the rod. The stabilizing bars may be connected through apertures in the spiral coiled portions of the lower guide spring and the upper guide spring.

The mechanism may further have a lower intermediate guide spring with an inner portion firmly connected to the rod and an outer portion firmly connected to the body. The inner portion is preferably connected to the outer portion by a spiral coiled portion which turns in opposite direction of the spiral coiled portion of the lower guide spring. Similarly, an upper intermediate guide spring may be provided with an inner portion firmly connected to the rod and an outer portion firmly connected to the body, the inner portion being connected to the outer portion by a spiral coiled portion which turns in opposite direction of the spiral coiled portion of the upper guide spring.

When in use, the rod moves axially relative to the body when a load is placed onto the seating device, so that the guide springs deform from a flat spiral shape to a conical spiral shape with axial movement of the rod relative to the body. The guide springs may be arranged to be normally flat or normally conical. A normally flat guide spring may be arranged within the seating device biased in a conical shape.

The guide springs may be made of steel, fiber-reinforced plastic, or any other similarly resilient material. The guide springs may have a cross section at their spiral coiled portions with a width to height ratio greater than 2:1. Width to height ratios of up to 5:1 or even 10:1 may be used. The guide springs may be cut or punched out of a sheet of steel, in particular out of a sheet of spring steel.

Inevitably, gaps are formed convolutions of the spiral coiled portion of the lower guide spring and/or the upper guide spring. Those gaps may be filled with an elastomer.

While the guide springs may be able to absorb an axial force, it is more beneficial if the mechanism further includes a load spring which counteracts axial movement of the rod relative to the body. The load spring may be a compression spring or a tension spring.

An improved seating device includes a base with a base body, a seat, a rod firmly connected to the seat, a lower guide spring, and an upper guide spring. The lower guide spring has an inner portion firmly connected to the rod and an outer portion firmly connected to the base body. The inner portion of the lower guide spring is connected to its outer portion by a spiral coiled portion. Similarly, the upper guide spring has an inner portion firmly connected to the rod and an outer portion firmly connected to the base body. Here, also, the inner portion of the upper guide spring is connected to its outer portion by a spiral coiled portion. The spiral coiled portions may have two or more convolutions. An elastomer may be arranged between the two or more convolutions, filling a gap between the between the spiral convolutions.

The seating device may use a load spring to counteract axial movement of the rod relative to the base. The load spring may be a compression spring, an extension spring, or a combined compression and extension spring. Use of compression springs is preferred, since they provide an inherent hard stop when fully compressed and cannot be overloaded. The load spring may be a compression spring arranged between a lower end of the rod and the base. The load spring may also be a compression spring arranged around the rod between the seat and the base.

The seating device may have a plurality of stabilizing bars which are circumferentially spaced around the rod and connect the spiral coiled portion of the lower guide spring with the spiral coiled portion of the upper guide spring.

The base body of the seating device may be formed by a plurality of arms, each extending from a lower end to an upper end. The upper guide spring may be seated on the upper ends of the arms forming the base body.

The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION

Figure 1:
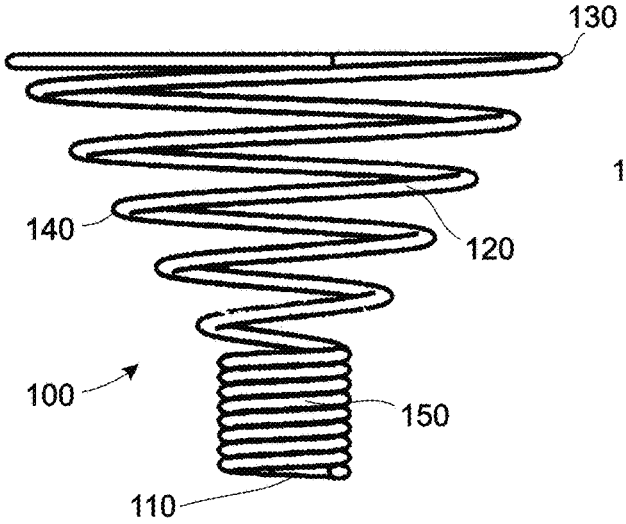
FIG. 1 is a side view of a guide spring made of round wire having a conical compression spring section and a cylindrical inner spring thread section.
Figure 2:
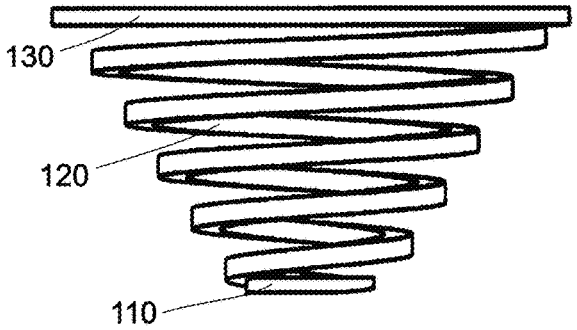
FIG. 2 is a side view of a normally conical guide spring made of wire with generally rectangular cross section.
Figure 3:
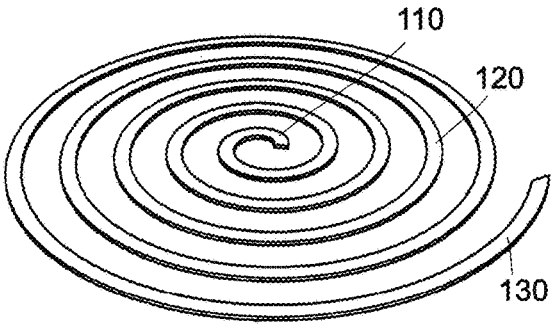
FIG. 3 shows a normally flat spiral spring having a width to height ratio of 3:1 to provide enhanced lateral guidance.
Figure 4:
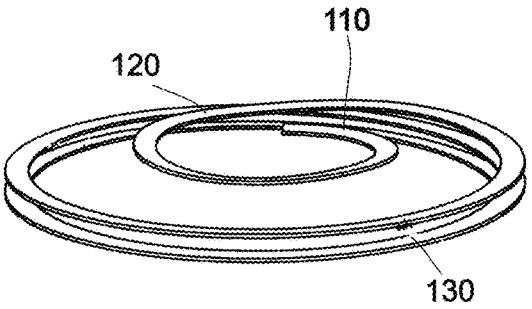
FIG. 4 shows an alternative guide spring.
Figure 5:
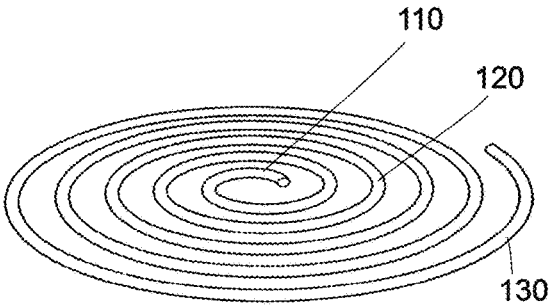
FIG. 5 shows yet another normally flat guide spring.
Figure 6:
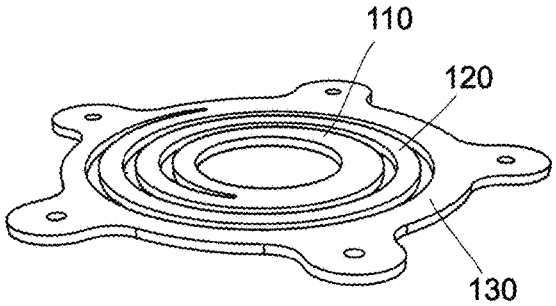
FIG. 6 is a perspective view of normally flat guide spring which has been laser cut from spring steel or may be molded from fiberglass-reinforced plastic. The guide spring includes radially protruding attachment extensions.

An improved sprung seating device and its spring mechanism are based on one or more guide springs 100, examples of which are shown in FIG. 1 through FIG. 6. The guide springs may be normally flat as shown in FIG. 3, FIG. 5 and FIG. 6. Alternatively, guide springs may have a normally tapered shape as shown in FIG. 1 and FIG. 2.

The guide springs 100 extend from an inner portion 110 to an outer portion 130. A spiral coiled portion 120 connects the inner portion 110 with the outer portion 130 The inner portion 110 can move axially relative to the outer portion 130 and provides an axial force counteracting an axial deflection. The inner portion 110 can also move laterally (radially) relative to the outer portion 130. Normally, the inner portion 110 may be arranged concentric with the outer portion 130. The guide spring 100 creates a lateral (radial) force counteracting a lateral (radial) deflection of the inner portion 110 relative to the outer portion 130.

For use in seating applications, the guide spring 100 may be configured to allow an axial movement of the inner portion 110 relative to the outer portion 130. The maximum axial displacement of the inner portion from its normal position may be up to 10 cm, up to 13 cm, or even up to 15 cm. The lateral movement (maximum lateral displacement) may be limited to 1 cm or less. In a preferred embodiment the guide spring 100 has an outer diameter at its outer portion 130 of about 200 mm. The outer diameter is (preferably between 100 mm and 300 mm, even more preferably between 150 mm and 250 mm). The inner diameter at the inner portion 110 is about 40 mm. The inner diameter is preferably between 20 mm and 60 mm and even more preferably between 30 mm and 50 mm).

The response of the guide spring 100 to lateral and axial deflection can be adjusted by varying design parameters. For example, the guide spring may be made of different materials. The guide spring may be normally flat and may be cut out of a flat sheet of steel. One significant characteristic of the guide spring is the cross sectional shape of the spring at its spiral coiled portion 120.

Beneficially, the cross sectional shape of the spring at its spiral coiled portion 120 may have a maximum height and a maximum width with a width to height ratio greater than two. The cross sectional shape of the spring may be generally rectangular with a width to height ratio between 2:1 and 5:1. A width to height ratio of up to 10:1 or more is possible. A spring having a width to height ratio of 10:1 or more is practically laterally immovable. Through selection of these design parameters the overall usability and "feel" of a seating device 300 in which the guide spring 100 is used can be selected.

Referring to FIG. 1, a first exemplary guide spring 100 is formed by a conical compression spring section 140, the inner end of which extends into a cylindrical extension spring section 150. The guide spring 100 extends between an outer portion 130 at an upper end of the conical spring section 140 and an inner portion 110 at a lower end of the cylindrical extension spring section 150. The inner spring portion 110 and the outer spring portion 130 are connected by a spiral coiled portion 120. The guide spring 100 as shown in FIG. 1 may be made of wound spring steel wire with a round cross section. The cylindrical extension spring section 150 may be used to engage threads of a rod. The guide spring 100 may be used to simultaneously provide lateral guidance and an axial load force.

Figure 12:
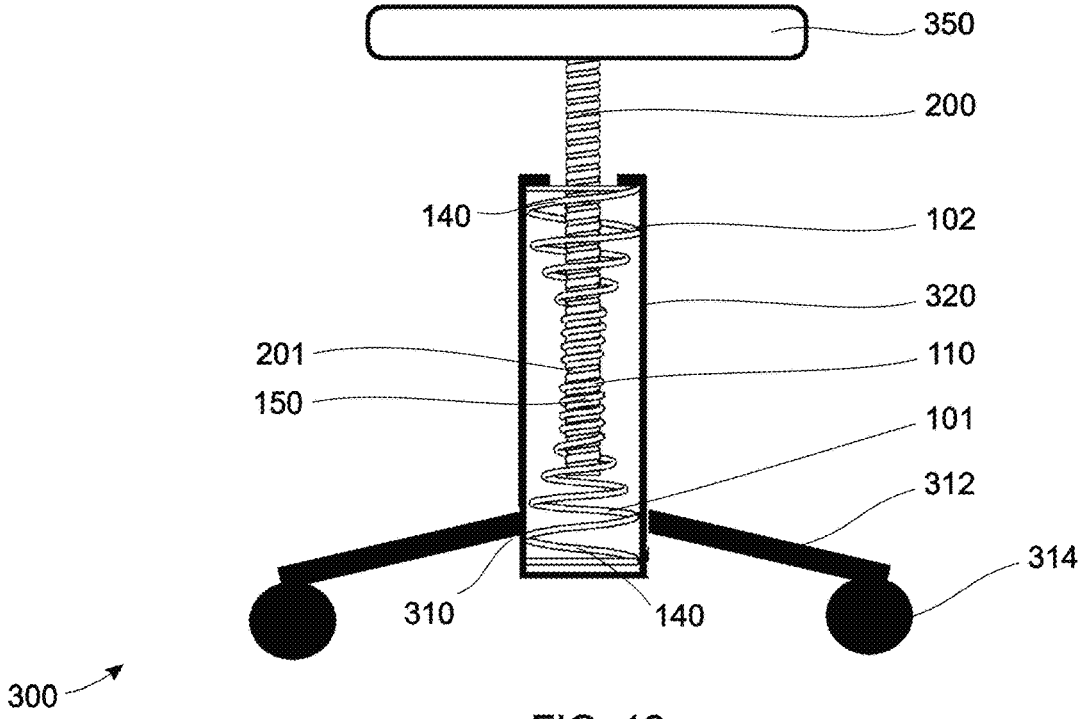
FIG. 12 shows a seating device with threaded seat rod.
Figure 13:
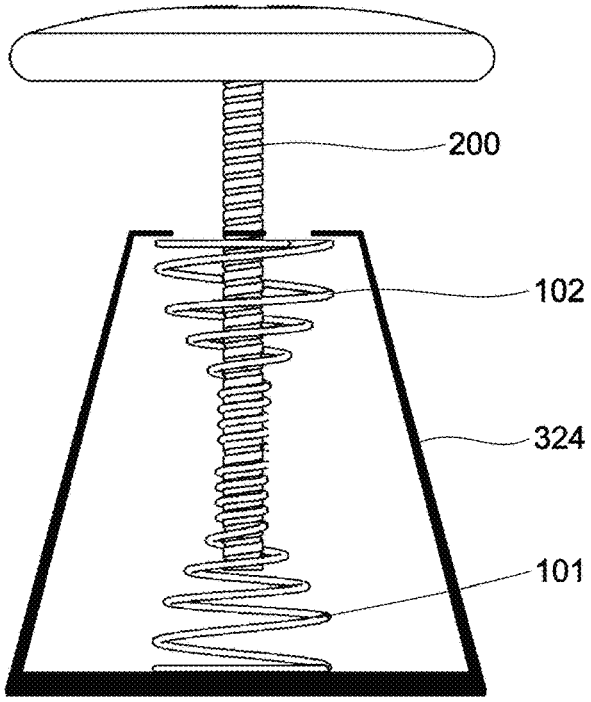
FIG. 13 shows a seating device with conical base body.
Figure 14:
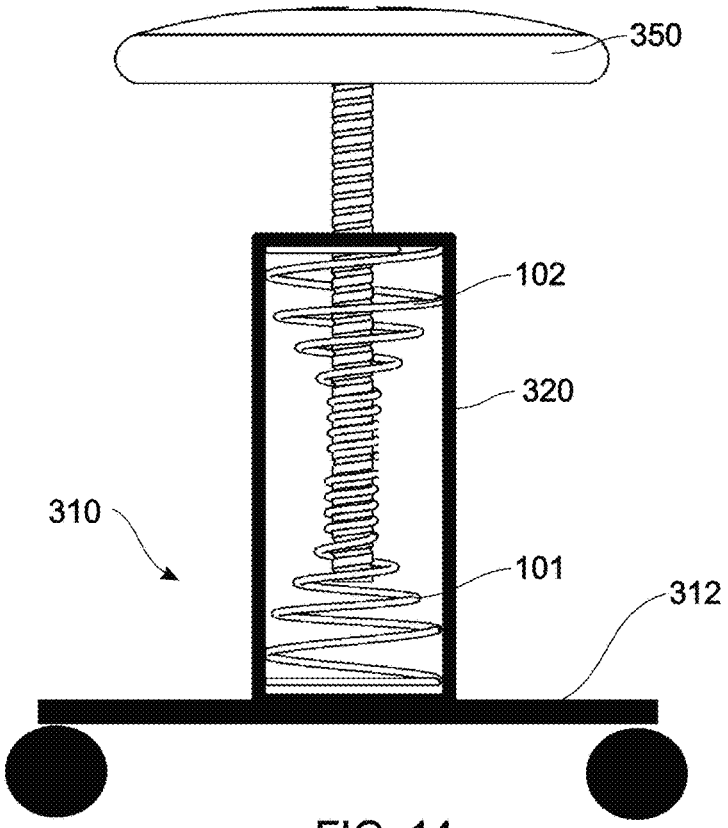
FIG. 14 shows a seating device with cylindrical base body.

Exemplary seating devices 300 which use the guide spring 100 as shown in FIG. 1 are illustrated in FIG. 12, FIG. 13 and FIG. 14. The seating device 300 as shown in FIG. 12 comprises a base 310 with a generally cylindrical base body 320. The base 310 comprises a plurality of radiating arms 312 which project outwardly from a lower end of the cylindrical base body 320. Casters or wheeled supports 314 are secured to distal ends of the arms 312 for supporting the base 310 and enabling rolling movement of the base 310 on a support surface (e.g., floor).

A seat 350 is secured to a seat rod 200. The seat rod 200 is held coaxially within the cylindrical base body 320 by a lower guide spring 101 and an upper guide spring 102. The lower guide spring 101 and the upper guide spring 102 are of the type shown in FIG. 1. The lower guide spring 101 is oriented such that the conical compression spring section 140 is supported on lower end of the cylindrical base body 320. The upper guide spring 102 is arranged in opposite orientation. The conical compression spring section 140 of the upper guide spring 102 is secured at an upper end of the cylindrical base body 320.

The inner portion 110 of the lower guide spring 101 is axially immovably secured to the seat rod 200 in form of a threaded connection. As shown, an outer surface of the seat rod 200 contains threads 201 into which the cylindrical compression spring section 150 reaches. The inner portion of the upper guide spring 102 is axially immovably secured to the seat rod 200 in the same manner.

The lower guide spring 101 and the upper guide spring 102 serve two different functions: Firstly, the guide springs act as compression springs to counteract a weight placed onto the seat 350, thereby providing a sprung seat arrangement. When a weight is placed onto the seat 350, the lower guide spring 101 is compressed, resulting in a push force which counteracts the weight. The upper guide spring 102 is extended, resulting in a pull force which counteracts the weight. Secondly, the guide springs 101, 102 provide lateral guidance of the seat rod 200 within the base body 320.

The lower guide spring 101 and the upper guide spring 102 are resiliently deformable in both axial direction and in lateral direction. A configuration with a wound round wire spring element as shown in FIG. 1 is preferably used in seating devices where some lateral movement of the seat 350 is desirable. Such an active seating configuration can replicate the benefits of sitting on an exercise ball. A lateral movement of the seat 350 causes the inner portion of the upper guide spring 102 to be deflected in the same direction as the seat 350. The inner portion of the lower guide spring 101 is deflected in opposite direction. The lateral deflection of the inner portions of the guide springs 101, 102 causes a stabilizing force which is directed to return the tilted seat rod 200 into an upright orientation and thereby push the seat 350 into its normal position.

A generally conical shaped base body 324 as shown in FIG. 13 allows for increased lateral movement of the seat 350, respectively increased tilt angles of the seat rod 200. The base body 324 can be placed directly onto a floor without wheeled supports, thereby preventing movement of the base even when the seat 350 is laterally deflected. The lower guide spring 101 and the upper guide spring 102 can be of the same type or different types. For example, the lower guide spring 101 can be selected to have a larger outer diameter than the upper guide spring 102. The seat 350 is height-adjustable by rotating the threaded seat rod 200 within the inner compression spring sections of the guide springs. To build a non-adjustable seat a regular, non-threaded seat rod may be used.

FIG. 14 shows a design similar to that shown in FIG. 12 with a different base 310. As shown, the cylindrical base body 320 is placed on top of radiating arms 312. The seat 350 is height adjustable by rotating the threaded seat rod 200 relative to the guide springs 101, 102.

Figure 11:
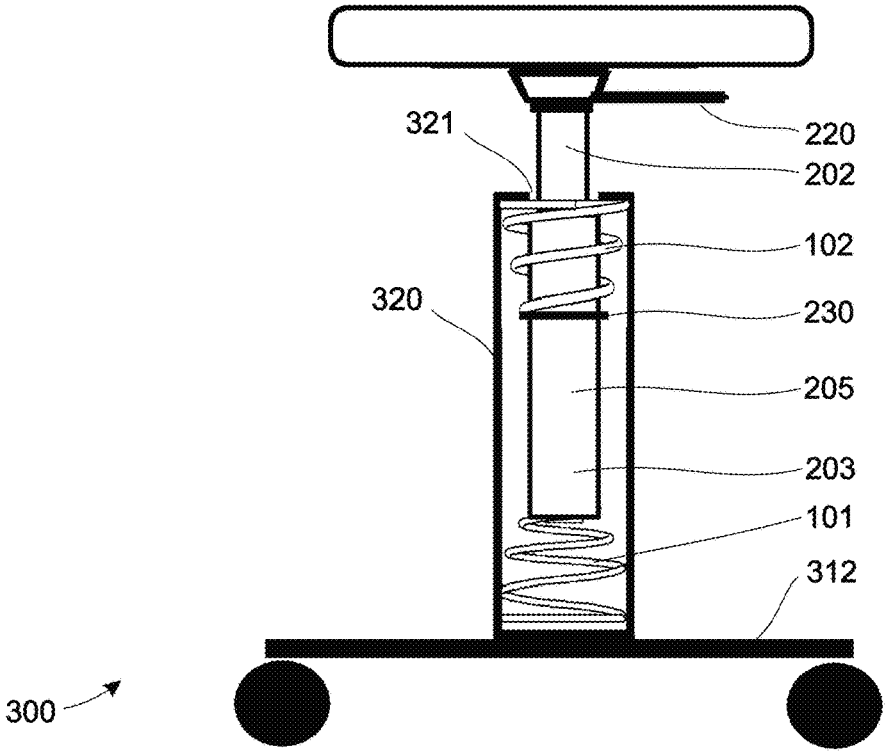
FIG. 11 shows a seating device with height adjustable seat rod.

FIG. 11 shows a configuration of a seating device 300 with a height-adjustable rod 205 which is supported by a lower guide spring 101 and an upper guide spring 102 as shown in FIG. 2. The height-adjustable seat rod 205 comprises a hollow cylindrical rod 203 which accommodates a coaxial inner rod 202. The inner rod 202 can move axially within the hollow cylindrical rod 203 when a release lever 220 is pulled. The hollow cylindrical rod 203 is held within the cylindrical base body 320 of the seating device 300. The inner portion of the lower conical guide spring 101 is firmly secured to a lower end of the hollow cylindrical rod 203. The outer portion of the lower conical guide spring 101 rest on or is secured to a lower end of the cylindrical base body 320. The lower inner end of the upper guide spring 102 is secured in an upper region of the hollow cylindrical rod 203 with a bracket 230. The upper outer portion of the upper guide spring 102 is secured to an upper end of the cylindrical base body 320.

The inner rod 202 extends upwardly through an opening 321 of the cylindrical base body 320. The size of the opening 321 relative to the outer diameter of the inner rod 202 and the outer diameter of the hollow cylindrical rod 203 relative to the inner diameter of the cylindrical base body 320 determine a maximum lateral deflection of the seat 350. The maximum lateral deflection of the seat 350 may be further controlled by providing an adjustment mechanism (not shown) to control the diameter of the openings 321.

The conical guide spring 102 as shown in FIG. 2 and as used in the seating device shown in FIG. 11 has a generally rectangular cross section having a width and a height. The width to height ration of the spiral coiled portion of the lower guide spring 101 and the upper guide spring 102 determines the response of the guide spring 101, 102 to lateral and axial forces. A guide spring 101, 102 with a larger width to height ratio is more easily deflected axially and more resistive to lateral deflection than a guide spring with the same cross sectional surface area but a lower width to height ratio.

Figure 20:
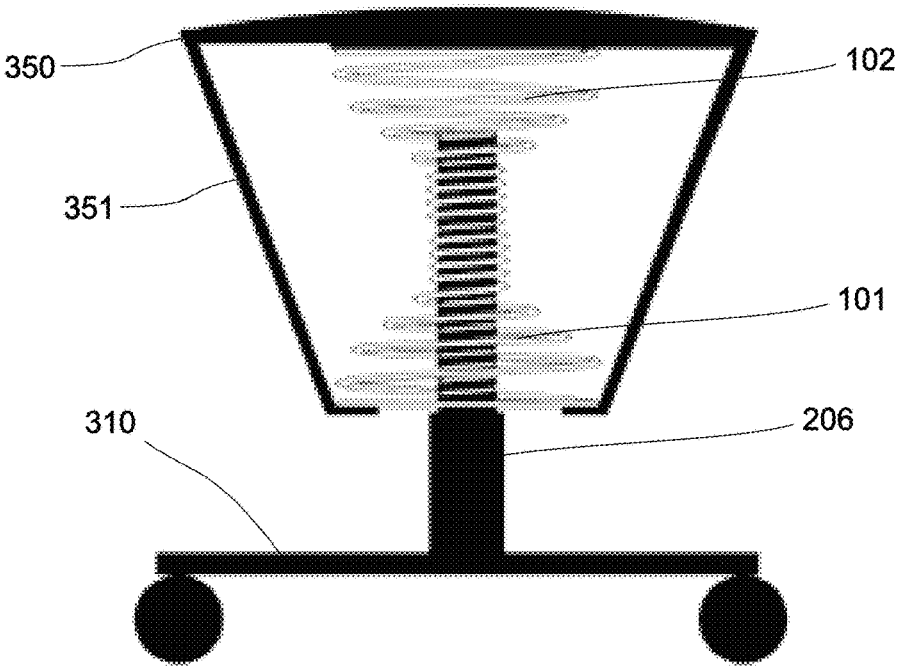
FIG. 20 is a cross sectional view of a seating device with a conical seat body.
Figure 21:
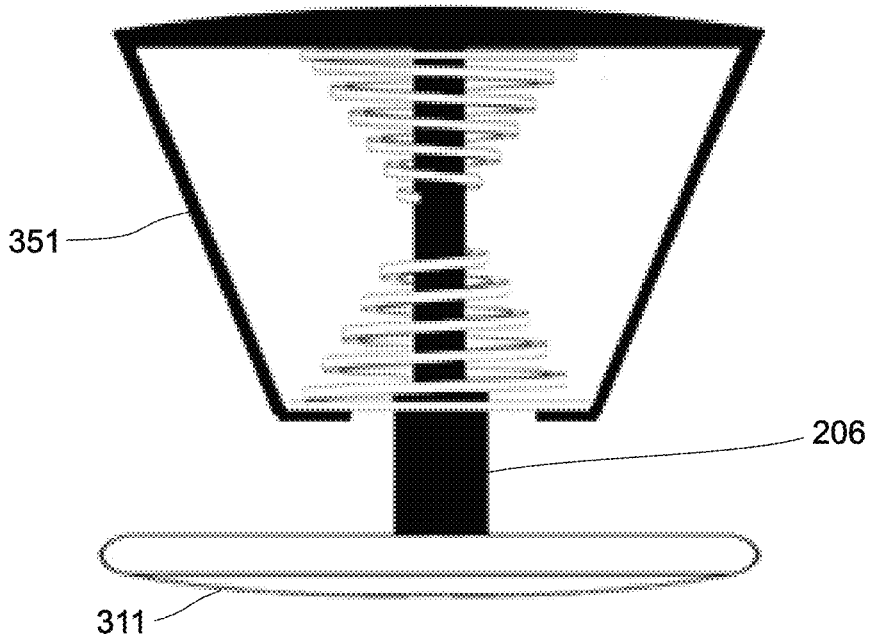
FIG. 21 is a cross sectional view of a highly dynamic seating device.

In the seating devices shown in FIG. 11-14 the seat rod 205 is firmly attached to the seat 350 and moves axially and laterally within a base body. The base body in those embodiments is firmly attached to a base. The base may or may not be equipped with wheels to allow movement relative to a floor. An alternative configuration is shown in FIG. 20 and FIG. 21. Here, a base post 206 is firmly attached to a base 310. The seat 350 in this configuration comprises a hollow conical seat body 351 within which a lower guide spring 101 and an upper guide spring 102 are arranged. Shown in FIG. 20 is an embodiment using the guide spring as shown in FIG. 1. A threaded outer surface of the base post 206 engages the inner portion of the lower guide spring 101 and the upper guide spring 102. The outer portion of the upper guide spring 102 is attached to an upper end of the seat body 351. The outer portion of the lower guide spring 101 is secured around an opening at the lower end of the seat body 351. The seat 350 is height-adjustable by rotating the seat 350 and with it the lower and upper guide springs 101, 102 relative to the base post 206. The conical shape of the seat body 351 provides a wide range of tilting motion of the seat 350. The lower guide spring 101 and the upper guide spring 102 absorb axial forces placed onto the seat 350 through compression of the lower guide spring 101 and extension of the upper guide spring 102. The guide springs also provide lateral guidance of the seat body 351, creating a resetting force that urges the seat 350 into a normal position coaxial with the base post 206 when laterally deflected.

The exemplary seating device shown in FIG. 21 utilizes the same conical seat body 351 shown in FIG. 20 and guide springs with a generally rectangular cross section as shown in FIG. 2. The lower portion of the base which rests of the floor is formed as a spherical cap 311. The base 310 and with it the base rod 206 can thus pivot about the lower base portion. Also, the seat 350 can move axially and pivot relative to the base rod 206. The use of normally conical guide springs allows for large vertical displacement. The high degree of movability of the seat 350 as shown in FIG. 21 typically requires some practice and/or training for a user to use comfortably.

Figure 15:
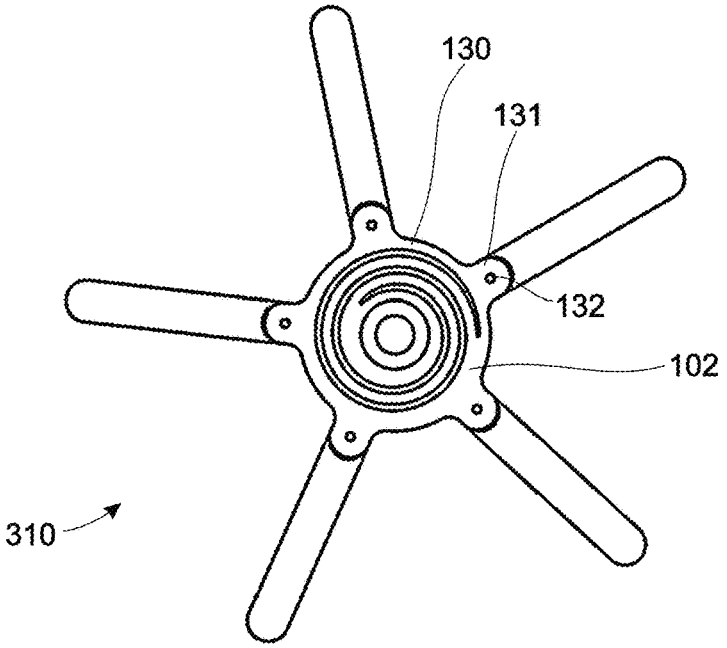
FIG. 15 is a top view of a base of a seating device.
Figure 16:
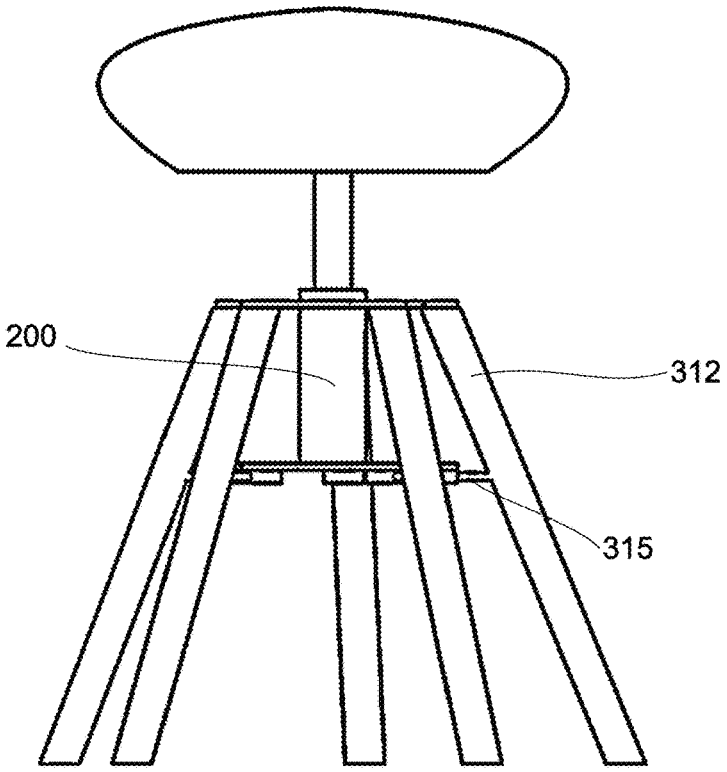
FIG. 16 is a side view of the seating device using the base as in FIG. 15.
Figure 17:
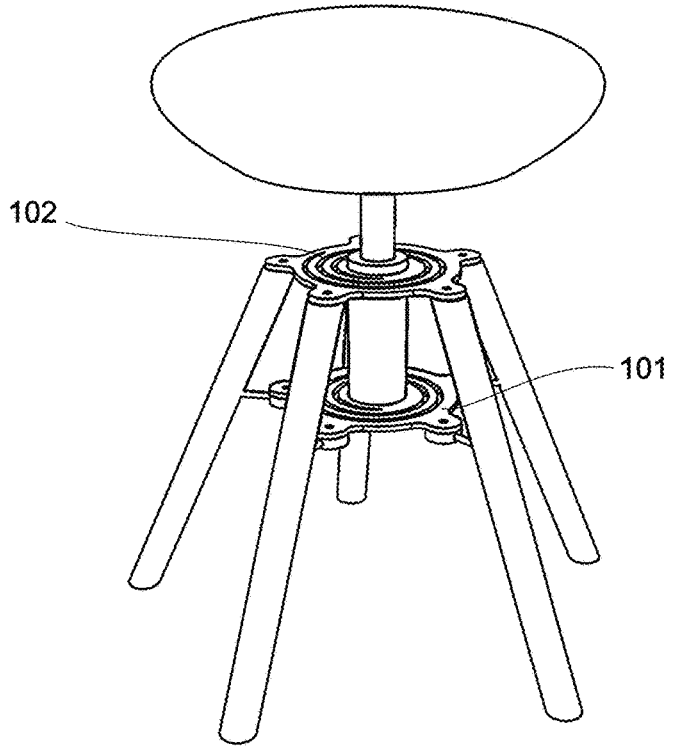
FIG. 17 is a perspective view of the seating device as in FIG. 16.

Referring to FIGS. 16 and 17, a seating device 300 is shown in a side view and a perspective view. A top view of the base 310 of the seating device is shown in FIG. 15. The base 310 comprises a plurality of five arms 312 which are connected to each other at their upper ends. More specifically, the upper ends of the arms 312 are securely attached to an outer portion 130 of an upper guide spring 102. The guide spring 102 is of the normally flat type shown in FIG. 6. The outer portion 130 of the guide spring 102 has radial extensions 131 with a central hole 132 therein. The upper end of the arms 312 can be secured to the guide spring 102 with screws that reach through the holes 132 to engage a corresponding thread in the upper portion of the arms 312.

The guide spring 100 as shown in FIG. 15 and FIG. 6 comprises an outer portion 130 which is shaped as a closed ring and from which the radial extensions 131 outwardly project. An inner portion 110 is also shaped as a closed ring concentrically with the outer portion 130. A spiral coiled portion 120 extends between the inner portion 110 and the outer portion 130 in approximately 1¼ convolutions.

The guide spring 100 is made of a resilient material. The guide spring 100 may e.g. be cut out of a planar sheet of spring steel. The guide spring may be cut by a laser or a water-jet out of a sheet of steel or punched out of a sheet of steel. Alternatively, the guide spring 100 can be molded, e.g. made of plastic with large fiber content.

A lower guide spring 101 is arranged axially spaced below the upper guide spring 102. The lower guide spring is firmly attached to the arms 312. More specifically, radial extensions 131 of the lower guide spring may be screwed into a lateral attachment extension 315 formed onto the arms 312.

A seat rod 200 is firmly attached to a seat 350. The seat rod 200 is securely attached to the inner portions 110 of the lower guide spring 101 and the upper guide spring 102.

When no weight is placed onto the seat 350 the lower guide spring 101 and the upper guide spring 102 retain their generally flat normal orientation. In that orientation the inner portion 110, the outer portion 130 and the connecting spiral coiled portion 120 are generally arranged within a common plane. The inner portion 110 of the guide spring is concentric with the outer portion.

Figure 10:
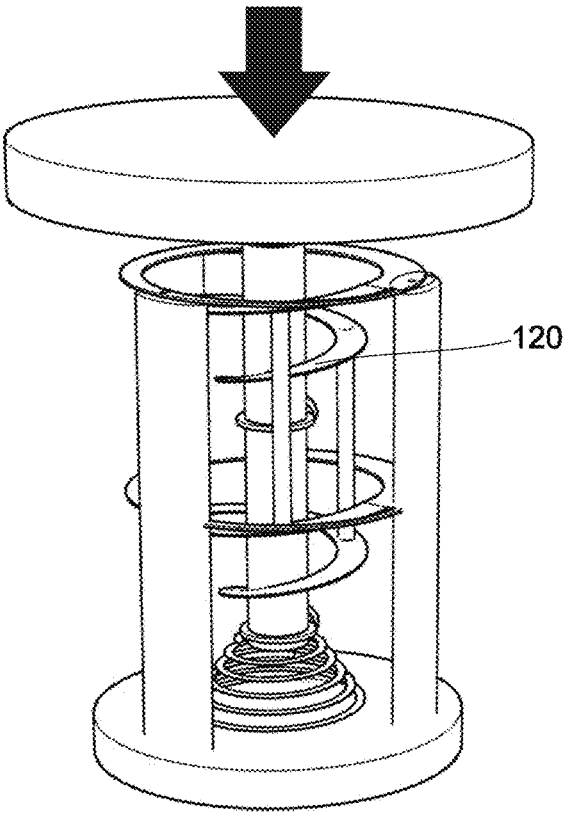
FIG. 10 shows a seating device in a loaded state.

When a weight is placed onto the seat 350 as indicated by a bold arrow in FIG. 10, the lower guide spring 101 and the upper guide spring 102 deform. The inner portion 110 of the springs moves downwardly below the outer portion 130. The flat spiral shape of the spiral coiled portion 120 becomes a conical spiral shape.

The spiral coiled portion of 120 of the guide springs is wider than it is tall. The height of the spiral coiled portion 120 is determined by the thickness of the metal sheet from which it is cut. The width of the spiral shaped portion is determined by design of the shape which is cut out of the steel. Given its width to height ratio the guide spring resists lateral deflection of its inner portion 110 more than it resists axial deflection of its inner portion 110. A preferably width to height ration of the coiled portion of the guide spring in this configuration is 3:1.

The lower and upper guide springs 101, 102 in the seating device as shown in FIG. 17 have to be sufficiently strong to accommodate the weight of a maximum weight user, for example 200 kg. Consequently, the height of the guide spring has to be selected appropriately.

Figure 18:
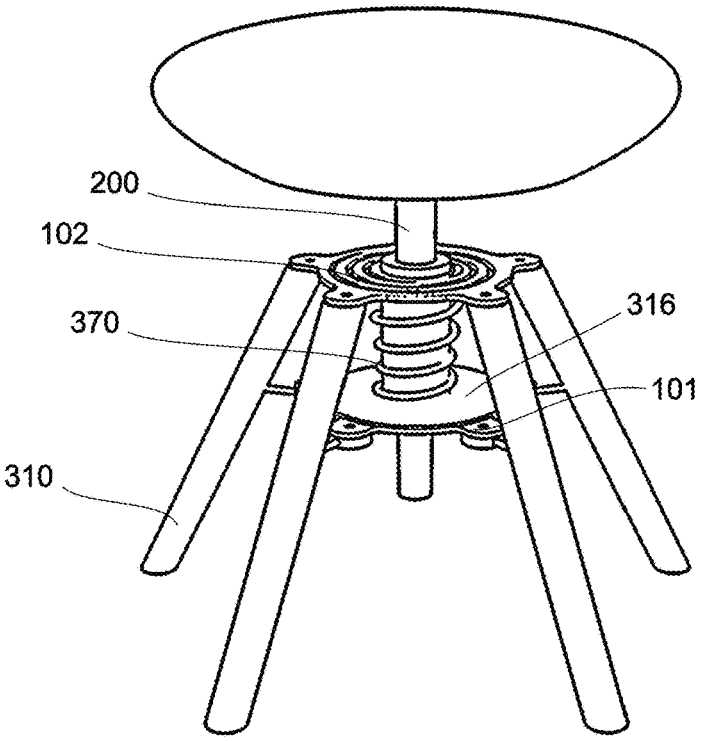
FIG. 18 shows the seating device as in FIG. 17 with an additional compression spring.
Figure 19:
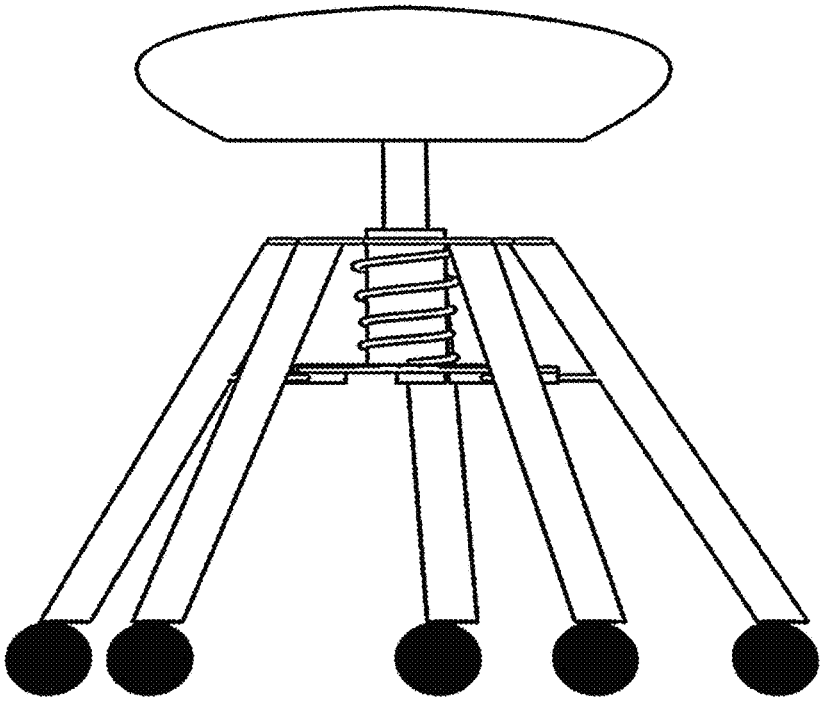
FIG. 19 is a side view of a seating device with casters.

Referring now to FIG. 18 and FIG. 19, an alternative design is shown which allows for significantly thinner guide springs 101, 102. Here, the guide springs 101, 102 are provided primarily to provide lateral guidance of the seat rod 200. The weight of a user is absorbed by a separate compression spring 370, which may be of conventional wound wire design. A lower end of the compression spring 370 rest on top of a base plate 316 which is arranged above the lower guide spring 101. The base plate 316 is attached jointly with the lower guide spring 101 to the base 310. An upper end of the compression spring is arranged below the upper guide spring 102. When a weight is placed on to the seat, the inner portion 110 of the upper guide spring 102 is now supported by the upper end of the compression spring, which transfers the compressive force through the base plate 316 into the base 310.

Figure 9:
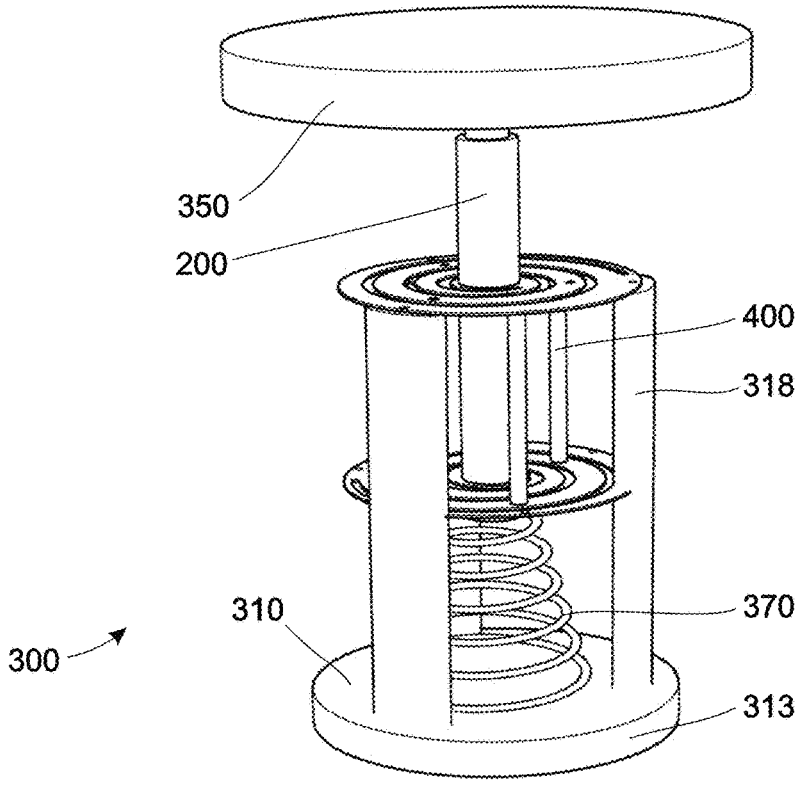
FIG. 9 shows a seating device in a normal state.

A further improved embodiment of a seating device is shown in FIG. 9 and FIG. 10. The seating device 300 comprises a base plate 313 with three vertical arms 318. The base plate 313 and the vertical arms 318 form a base body 320. Supported on top of an upper end of the vertical arms 318 is the outer portion 130 of an upper guide spring 102. The outer portion 130 of the guide spring 102 may comprise attachment holes through which the guide spring 102 is screwed to the arms 312.

Axially spaced below the upper guide spring 102 is a parallel lower guide spring 101. An outer portion 130 of the lower guide spring 101 is firmly attached to the vertical arms 318. The lower guide spring 101 and the upper guide spring 102 are arranged coaxially. A seat pole 200 is fixedly attached to inner portions 110 of the lower guide spring 101 and the upper guide spring 102. A seat 350 is firmly attached at an upper end of the seat pole 200.

Arranged between a lower end of the seat pole 200 and the base plate 313 is a conical compression spring 370. When in use, the conical compression spring 370 creates a counter-force to any weight placed onto the seat 350. The weight is indicated by a bold arrow in FIG. 10.

The upper and lower guide springs are primarily configured to provide lateral guidance of the seat post 200 within the base body 320 and contribute little axial force. To strengthen the guide spring's rigidity against lateral deflection even when the guide spring is axially deflected as shown in FIG. 10, circumferentially spaced stabilizing bars 400 are provided. The stabilizing bars 400 are symmetrically spaced along the spiral coiled portion of the lower and upper guide springs, thereby ensuring that the lower and upper guide springs must deflect symmetrically. As shown in FIG. 9, three stabilizing bars 400 may be used. However, more than three stabilizing bars may be provided. The use of stabilizing bars 400 has proven effective in tests, reducing lateral deflection of the guide springs when subjected to the same lateral force to less than 25% of the deflection without stabilizing bars. The additional stabilizing bars 400 can increase lateral rigidity of the guide spring arrangement fourfold.

The stabilizing bars 400 extend parallel to the seat rod 200. The stabilizing bars 400 may be formed as threaded bars which extend through apertures in the spiral coiled portions of the lower and upper guide spring. In such a configuration the spiral coiled portions may be secured to the stabilizing bars between two nuts. One skilled in the art will recognize that alternative attachment configurations exist. The stabilizing bars 400 prevent, in sections, a twisting of the spiral coiled portion when deflected from a flat shape into a conical shape, thereby increasing rigidity.

Due to the inevitably asymmetrical nature of a spiral the use of a single upper guide spring 102 and a single lower guide spring 101 may lead to asymmetrical forces and bias the seat 350 in one direction when a weight is placed thereon.

Figure 7:
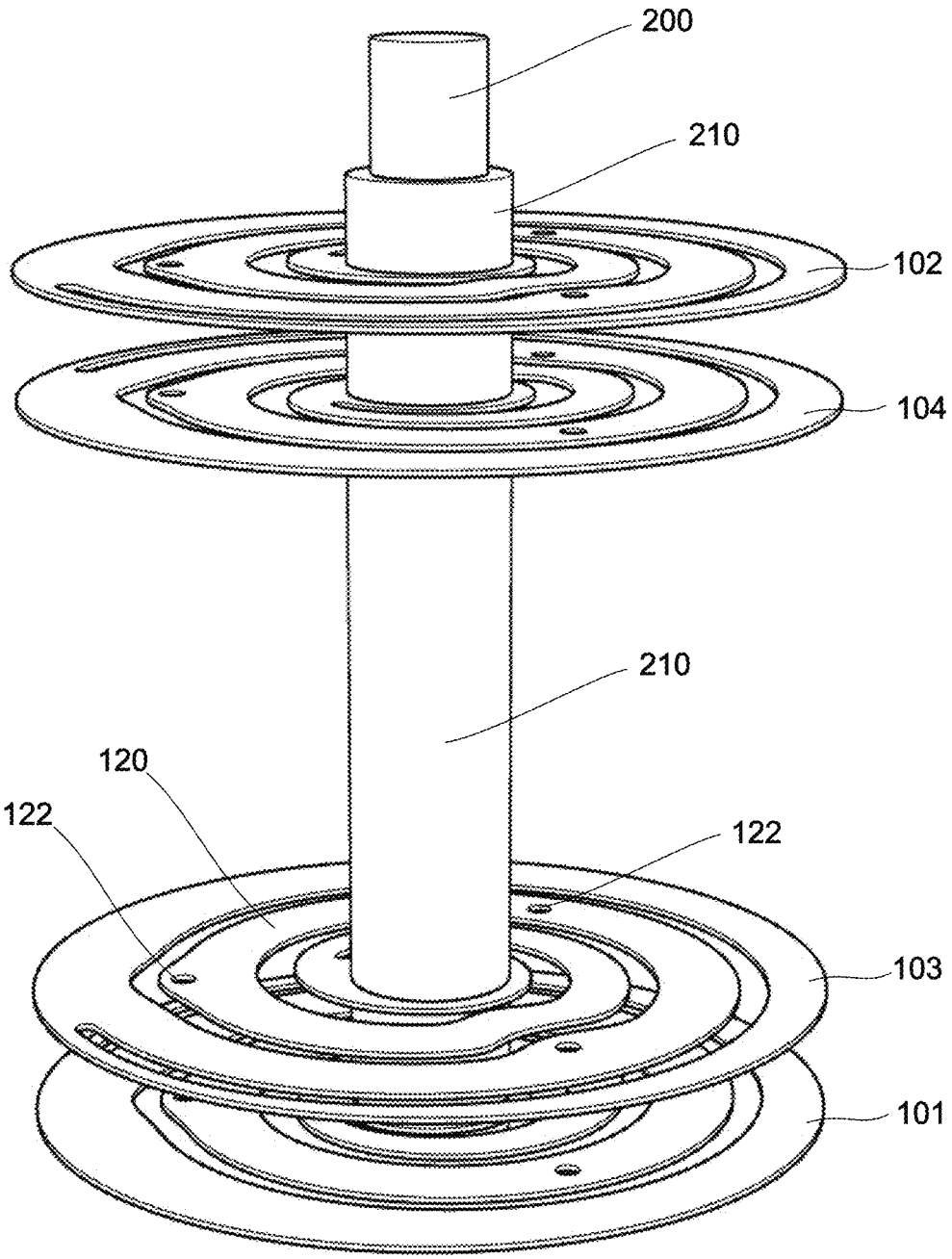
FIG. 7 shows a guide spring mechanism for a seating device.

To counter such asymmetry a mechanism for a seating device as shown in FIG. 7 may be used. Here, the single upper guide spring 101 is replaced by a pair of oppositely arranged upper guide springs 102, 104. The single lower guide spring 101 is replaced by a pair of oppositely arranged lower guide springs 101, 103. Within each pair of oppositely arranged guide springs one guide spring is arranged with its spiral coiled portion 120 in a clockwise orientation which the adjacent guide spring has a spiral coiled portion in a counter-clockwise orientation. For simplicity of illustration only apertures 122 for attaching stabilizing bars are shown in FIG. 7, but not the stabilizing bars themselves. Nevertheless, the quad-spring-configuration as shown in FIG. 7 may use stabilizing bars between each of the guide springs 101,103,102,104.

As shown in FIG. 7, the central rod may consist of a solid inner rod 200 and outer hollow cylindrical spacer elements 210. The inner portions of the guide springs may be clamped in-between two outer hollow cylindrical spacer elements 210, thereby securing the axial orientation of the inner portion of the guide spring.

Figure 8:
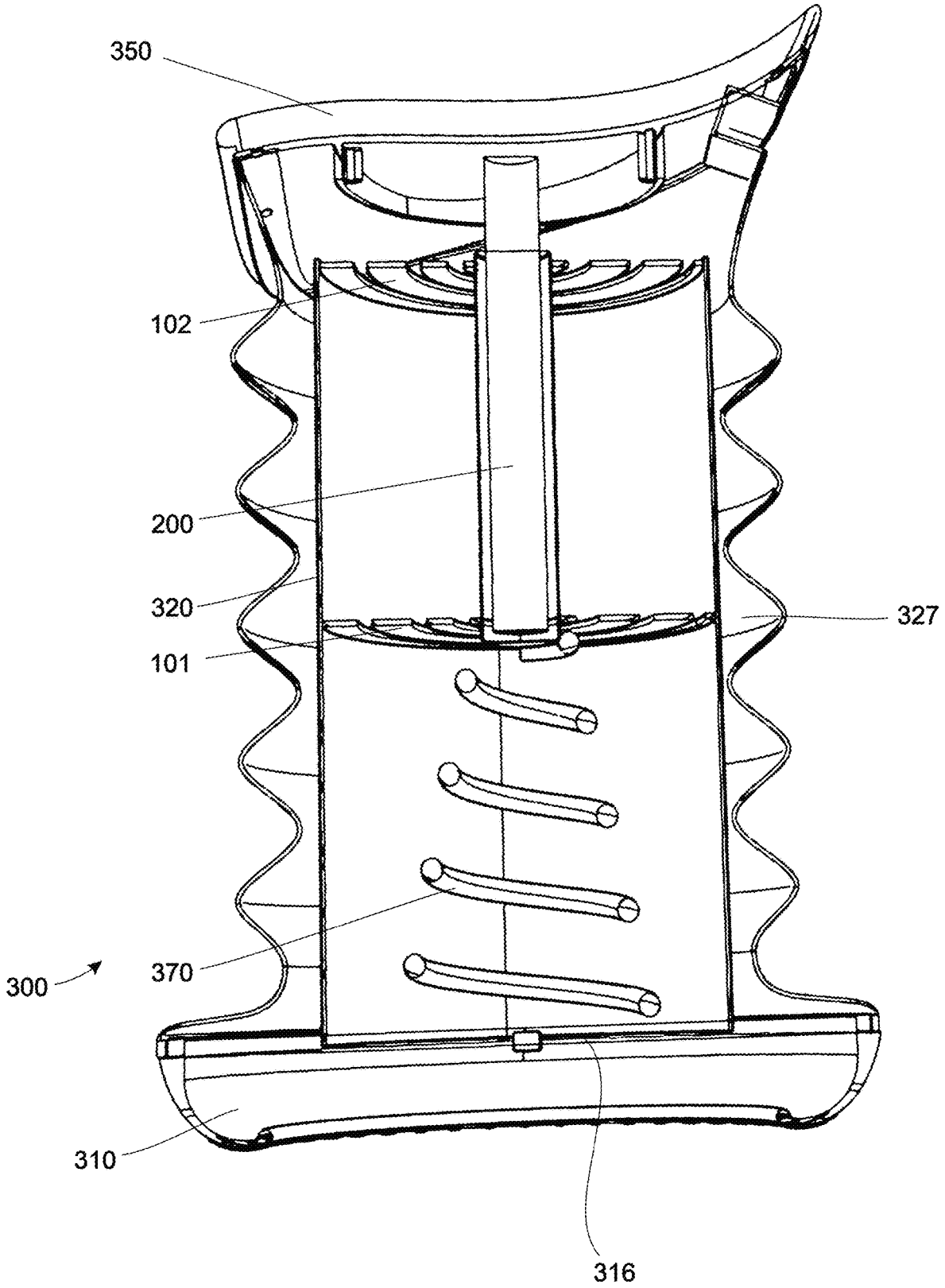
FIG. 8 is a perspective cross sectional view of a seating device.

Referring now to FIG. 8, a seating device 300 is shown in a perspective cross sectional view. The seating device utilizes a base 310 as disclosed in U.S. Pat. No. 9,894,998 which is hereby incorporated by reference. The base 310 allows a tilting motive of the seating device 300. A generally cylindrical base body 320 secures the outer portions of a lower guide spring 101 and an upper guide spring 102. The upper and lower guide spring provide axial movement of a seat rod 200. The width to height ratio of the spiral coiled portion of the guide springs is approximately 20 mm to 3 mm. Given this ratio, the guide springs are very inelastic in respect to lateral movement and function as frictionless axial bearings. When in use, the force of a user's weight is transferred from the seat 350 through the seat rod 200 and a compression spring 370 into a base plate 316 of the base 310. The base body 320 is hidden from external view within a bellows-shaped outer body 327.

Figure 22:
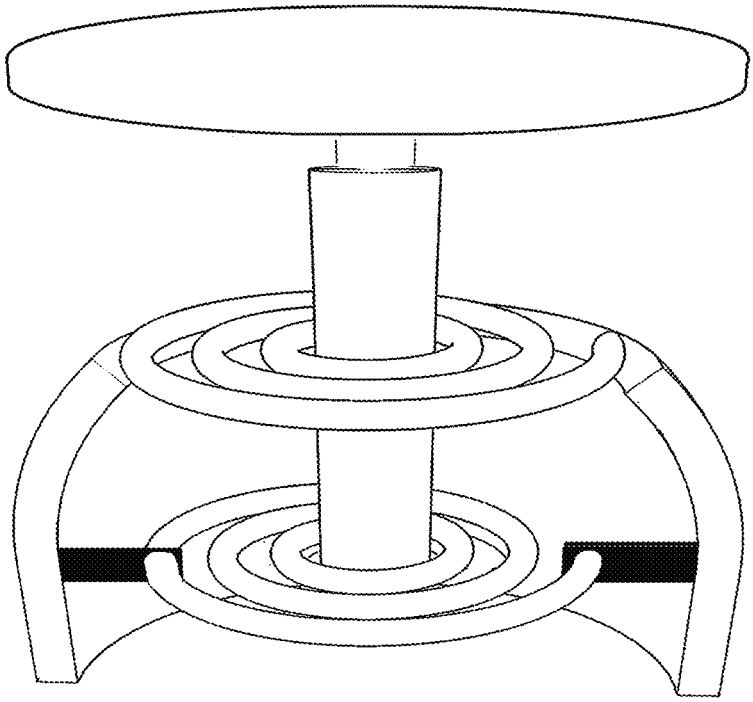
FIG. 22 is a cross sectional view of an alternative seating device.

Referring now to FIG. 22, a base body 320 in shape of a spherical segment 322 is provided. An outer portion 130 of an upper guide spring 102 rest on an upper opening of the spherical segment 322. A lower guide spring 101 is arranged within the base body and securely held within the base body by interior attachment arms 323.

Figure 23:
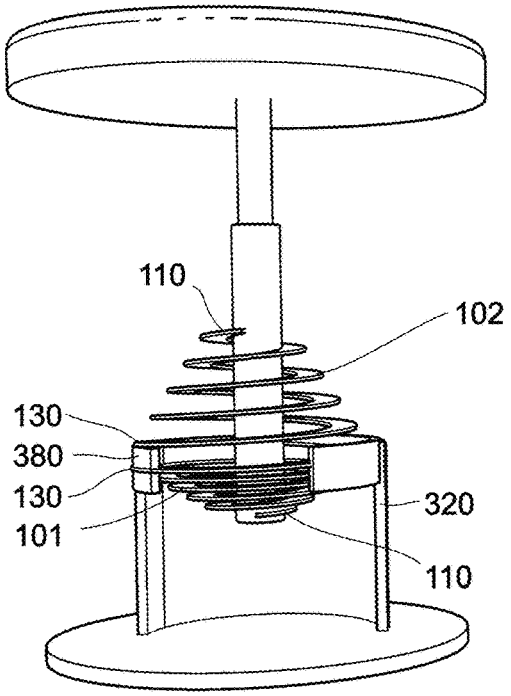
FIG. 23 is a partially cut view of yet another seating device.

An embodiment based on two oppositely biased guide springs 101, 102 is shown in FIG. 23. Here, the outer portion 130 of a both the lower guide spring 101 and the upper guide spring 102 are firmly attached to an annular retaining ring 380 which is arranged at an upper end of a generally cylindrical base body 320. The upper guide spring 102 is a normally flat spring which is biased into a conical shape. The inner portion of the upper guide spring 110 is arranged above its outer portion 130. The lower guide spring 101 is biased in the opposite direction, with its outer portion 130 being arranged above its inner portion 110. The lower guide spring 101 and the upper guide spring 102 thus form two coaxial cones with proximal bases and distant vertices. This arrangement is notably different from the arrangement shown in FIG. 13 and FIG. 14 where two conical guide springs are arranged coaxially with their vertices pointing towards each other.

The dynamic behavior of a seat, in particular its resistance to lateral movement, can be affected by several factors:

1) The vertical distance between the upper guide spring and the lower guide spring. The further apart the guide springs are arranged, the better they resists lateral forces.
2) The vertical distance of the outer portion of the guide spring relative to the inner portion of the guide spring. The closer the inner and outer portion of a guide spring are to being in a common plane, the better it resists lateral forces.
3) The design of the guide spring, in particular the width to height ratio of its spiral coiled portion. The larger the width to height ratio, the better the guide spring resists lateral forces.

Referring to FIG. 4, a spiral guide spring having a rectangular profile in a normally conical arrangement is shown. The spring rises on its periphery. The upper end leads to the center and serves to hold the seat rod. This results in the advantage that a free intermediate space is created and the active part of the spring (the spring swings with its main weight on its outer diameter) can be covered, in order to avoid injury.

Referring to FIG. 5, a spiral spring in normally flat arrangement made of round steel wire is shown. It serves as a tension spring/compression spring, and at the same time as a lateral guide spring. The use of spring wire is inexpensive, but requires a greater vertical distance between the springs, so that the lateral resetting is present with sufficient strength.

Figure 24:
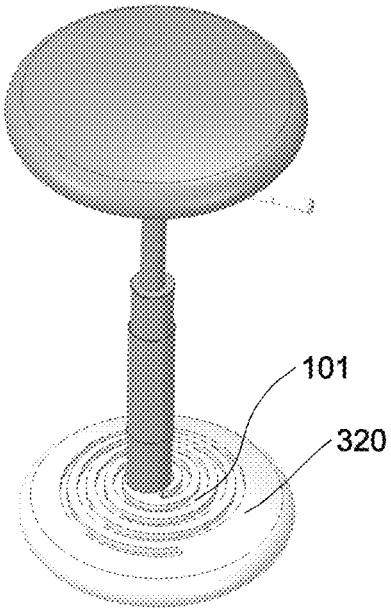
FIG. 24 is a perspective view of a seating device with a lower guide spring integrally formed in a base.
Figure 25:
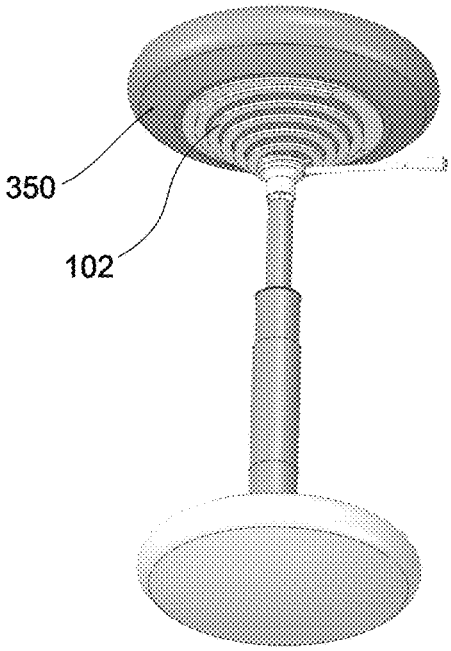
FIG. 25 is a perspective view of a seating device with an upper guide spring attached to a bottom of a seat.

Referring to FIG. 24 and FIG. 25, a stool is shown in which the lower guide spring 101 is integrally formed within a base body. The base body 320 may be injection molded and made of fiberglass reinforced plastic. The upper guide spring here is a normally tapered spiral spring, the upper outer portion of which is directly screwed onto a lower side of the seat 350.

Figure 26:
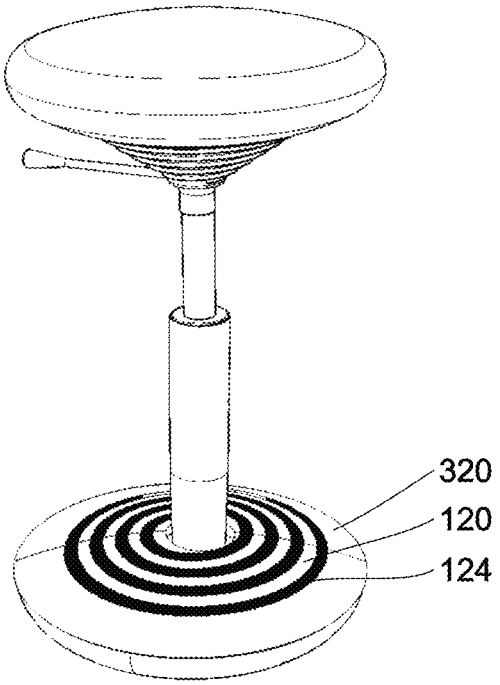
FIG. 26 is a perspective view of a seating device with a lower guide spring integrally formed in a base without visible gaps.
Figure 27:
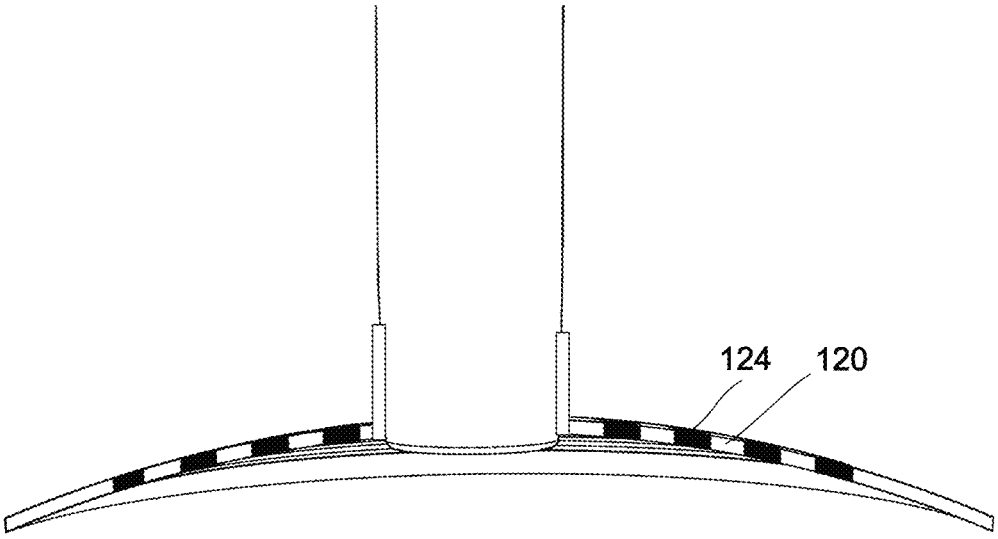
FIG. 27 is a cross sectional view of the guide spring as in FIG. 26 with elastomer-filled spiral portion.

A further beneficial improvement of the stool as in FIG. 24 and FIG. 25 is shown in FIG. 26 and FIG. 27. Here, the base body 320 also includes an integrated lower guide spring which includes a spiral coiled portion 120 extending more than one convolution between an inner portion and an outer portion. The spiral coiled portion is made of a resilient material, e.g. made of (spring) steel or fiberglass reinforced plastic. The spiral coiled portion can, when exposed to an external force, resiliently deform. In previously discussed embodiments a gap is formed between the convolutions of the spiral coiled portion 120. In the embodiment shown in FIG. 26 and FIG. 27 that gap is filled with an elastic material 124. The elastic material may be an elastomer, in particular rubber. In a particularly preferred embodiment the guide spring is made of steel or fiber-reinforced plastic (a first material) and gaps between convolutions of the spiral coiled portion of the guide spring are filled with rubber (a second material) which is bonded by vulcanization to the steel or plastic. The elastomer-filled guide spring offers an aesthetically pleasing design when no visible openings are desired. Also, a potential for accumulation of dirt entering the base through the lower guide spring is prevented, as is a potential interference with the seating device by external objects becoming jammed within the lower guide spring. A guide spring without gaps can prevent pinching accidents, and may be required to meet safety guidelines when the guide spring is externally accessible.

The elastomer-filled guide spring may be formed by over molding or vulcanizing an elastomer around a previously formed guide spring. Alternatively, an elastomer layer may be sandwiched between two guide springs, e.g. between an upper guide spring and an upper intermediate guide spring as shown in FIG. 7.

The elastomer is selected to be highly elastic, such that deformation of the guide spring between a flat shape and a conical shape is not impacted. In use, the elastomer which fills the gaps of the spiral shaped portion of the guide spring deforms jointly with the steel portion of the guide spring.

Figure 28:
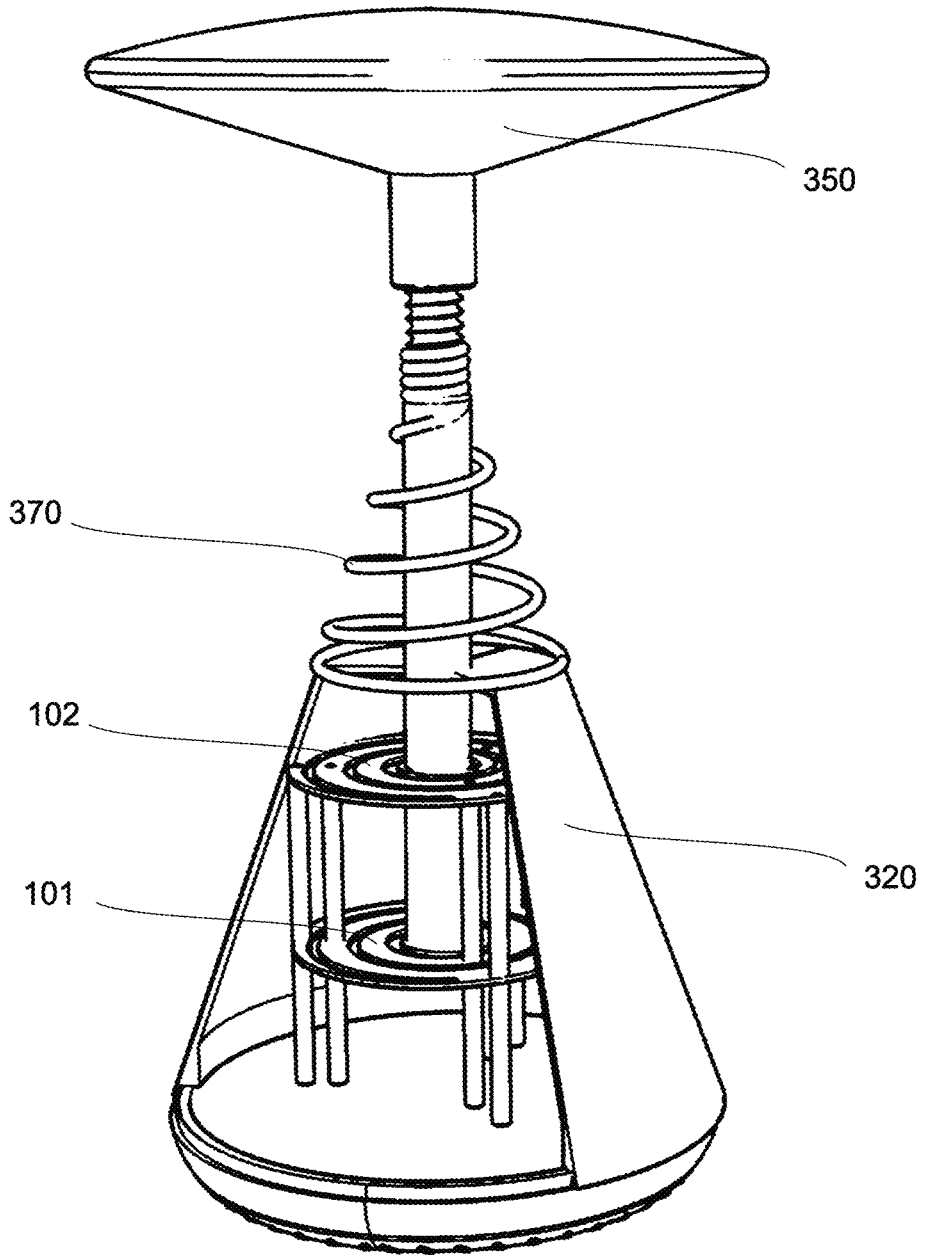
FIG. 28 is a partially cut open view of a seating device with two hidden guide springs and a visible load spring.

Yet another alternative seating device is shown in FIG. 28. Here, the compression spring 370 is arranged above the upper guide spring 102 between the seat 350 and the base body 320. The guide springs 101, 102, are hidden from view inside the base body 320 whereas the compression spring 370 is visible from the outside. In other embodiments both guide springs and the load spring are hidden inside a base (see e.g. FIG. 8) or all springs are visible (see e.g. FIG. 18).

Figure 29:
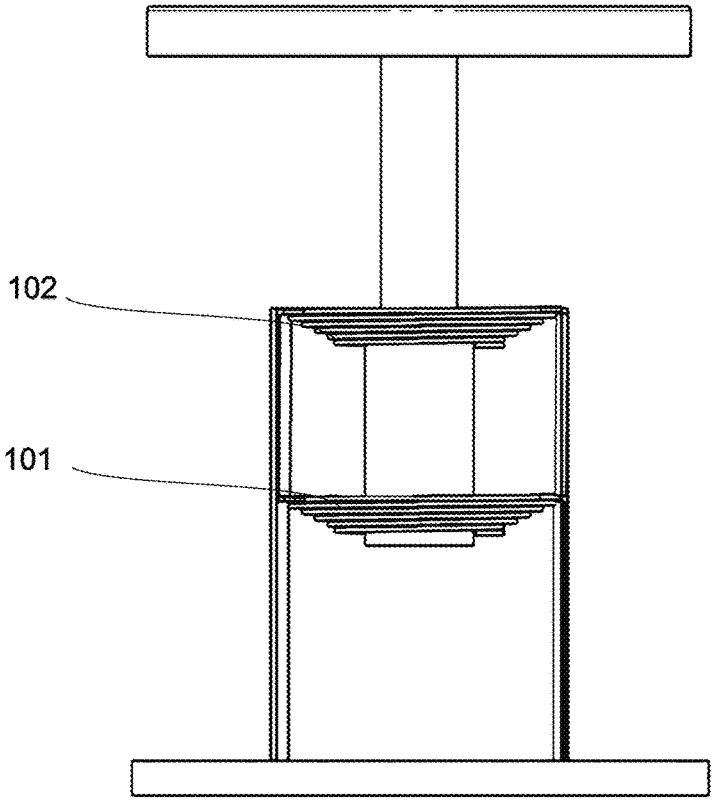
FIG. 29 is a partially cut open side view of another seating device.
Figure 30:
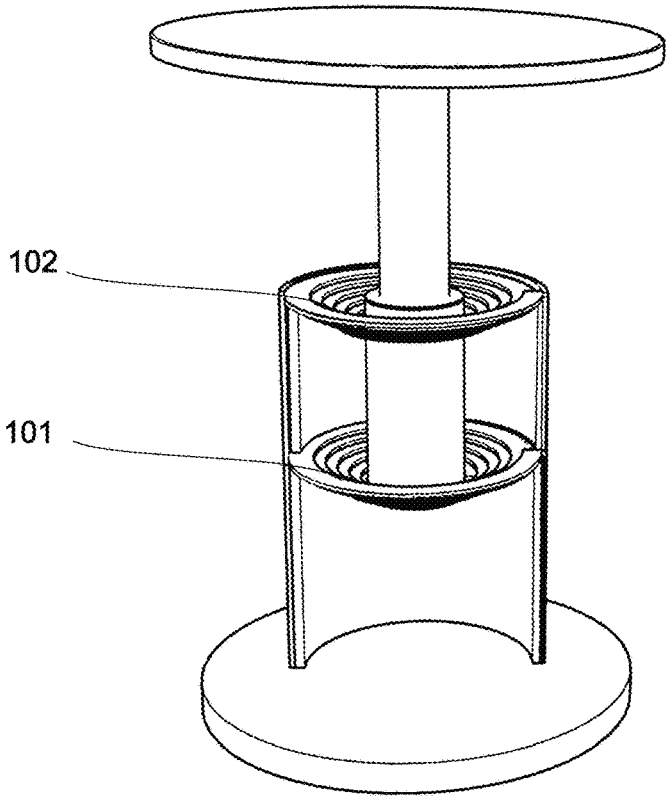
FIG. 30 is a partially cut perspective view of the seating device as in FIG. 29.

FIG. 29 and FIG. 30 show an arrangement of a seating device with lower guide spring 101 and upper guide spring 102 within a generally cylindrical base body without the use of a separate load spring.

Although the present disclosure relates to seating devices it is noted that the disclosed guide springs can be beneficially used in many different applications beyond seating devices in which a frictionless axial movement of an object within a range of axial displacement is desirable. Therefore, while the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A mechanism for a seating device, comprising:

a body;

a rod axially movable relative to the body;

a lower guide spring having an inner portion firmly connected to the rod and an outer portion firmly connected to the body, the inner portion being connected to the outer portion by a spiral coiled portion which wraps around a longitudinal axis of the rod; and an upper guide spring having an inner portion firmly connected to the rod and an outer portion firmly connected to the body, the inner portion being connected to the outer portion by a spiral coiled portion which wraps around the longitudinal axis of the rod.

2. The mechanism as in claim 1, further comprising a plurality of stabilizing bars which are circumferentially spaced around the rod and connect the spiral coiled portion of the lower guide spring with the spiral coiled portion of the upper guide spring.

3. The mechanism as in claim 2, wherein the stabilizing bars are arranged parallel to the rod.

4. The mechanism as in claim 2, wherein the stabilizing bars are connected through apertures in the spiral coiled portions of the lower guide spring and the upper guide spring.

5. The mechanism as in claim 1, further comprising:

a lower intermediate guide spring having an inner portion firmly connected to the rod and an outer portion firmly connected to the body, the inner portion being connected to the outer portion by a spiral coiled portion which turns in opposite direction of the spiral coiled portion of the lower guide spring; and an upper intermediate guide spring having an inner portion firmly connected to the rod and an outer portion firmly connected to the body, the inner portion being connected to the outer portion by a spiral coiled portion which turns in opposite direction of the spiral coiled portion of the upper guide spring.

6. The mechanism as in claim 1, wherein the rod moves axially relative to the body when a load is placed onto the seating device, and wherein the guide springs deform from a flat spiral shape to a conical spiral shape with axial movement of the rod relative to the body.

7. The mechanism as in claim 1, wherein the guide springs are made of steel and wherein a cross section of the guide springs at their spiral coiled portions has a width to height ratio greater than 2:1.

8. The mechanism as in claim 1, wherein the guide springs have been cut or punched out of a sheet of steel.

9. The mechanism as in claim 1, wherein gaps formed between convolutions of the spiral coiled portion of the lower guide spring and/or the upper guide spring are filled with an elastomer.

10. The mechanism as in claim 1, further comprising a load spring which counteracts axial movement of the rod relative to the body.

11. The mechanism as in claim 10, wherein the load spring is a compression spring which is arranged coaxially with the rod.

12. A seating device, comprising:

a base having a base body;

a seat;

a rod firmly connected to the seat and axially movable relative to the base body;

a lower guide spring having an inner portion firmly connected to the rod and an outer portion firmly connected to the base body, the inner portion being connected to the outer portion by a spiral coiled portion which wraps around a longitudinal axis of the rod; and an upper guide spring having an inner portion firmly connected to the rod and an outer portion firmly connected to the base body, the inner portion being connected to the outer portion by a spiral coiled portion which wraps around the longitudinal axis of the rod.

13. The seating device as in claim 12, further comprising a load spring which counteracts axial motion of the rod relative to the base.

14. The seating device as in claim 13, wherein the load spring is a compression spring arranged between a lower end of the rod and the base.

15. The seating device as in claim 13, wherein the load spring is a compression spring arranged around the rod between the seat and the base.

16. The seating device as in claim 12, further comprising a plurality of stabilizing bars which are circumferentially spaced around the rod and connect the spiral coiled portion of the lower guide spring with the spiral coiled portion of the upper guide spring.

17. The seating device as in claim 12, wherein the base body is formed by a plurality of arms, each extending from a lower end to an upper end, and wherein the upper guide spring is seated on the upper ends of the arms forming the base body.

18. The seating device as in claim 12, wherein the spiral coiled portion has two or more convolutions.

19. The seating device as in claim 18, wherein an elastomer is arranged between the two or more convolutions.

20. The seating device as in claim 12, wherein the lower guide spring is integrally formed in the base.

* * * * *